United States Patent [19]

Rothman et al.

[11] Patent Number: 5,039,165

[45] Date of Patent: Aug. 13, 1991

[54] WHEELCHAIR TOILETING MODULE AND METHOD

[75] Inventors: Neil S. Rothman, Randallstown; Woodrow Seamone, Rockville; Paul J. Biermann, Columbia; Frederick C. Jurgens, Ellicott City, all of Md.

[73] Assignee: The Johns Hopkins University, Baltimore, Md.

[21] Appl. No.: 507,821

[22] Filed: Apr. 12, 1990

[51] Int. Cl.[5] ..... A47K 11/04

[52] U.S. Cl. ..... 297/338; 297/DIG. 10; 297/DIG. 4; 297/284; 297/430; 4/480

[58] Field of Search ..... 297/284, 452, 183, 430, 297/DIG. 10, 339; 5/81 R, 81 C, 61, 88; 280/304.1

[56] References Cited

U.S. PATENT DOCUMENTS

| | | | |
|---|---|---|---|
| 184,559 | 11/1976 | Travis | 297/430 |
| 1,078,090 | 11/1913 | Foss | 5/81 R |
| 2,850,075 | 9/1958 | Wilson | 297/339 |
| 3,076,678 | 2/1963 | Griffin | 297/339 |
| 4,507,814 | 4/1985 | Zyki, Jr. | 5/81 R |
| 4,510,631 | 4/1985 | Grady | 297/DIG. 4 |
| 4,592,562 | 6/1986 | Strautnieks et al. | 297/DIG. 4 |
| 4,698,143 | 10/1987 | Morris | 204/253 |
| 4,900,048 | 2/1990 | Derujinsky | 280/281.1 |
| 4,933,040 | 6/1990 | Wesley, Jr. | 156/191 |
| 4,948,156 | 8/1990 | Fortner | 5/81 R |

*Primary Examiner*—Peter R. Brown
*Assistant Examiner*—Cassandra L. Hope
*Attorney, Agent, or Firm*—Robert E. Archibald; Francis A. Cooch

[57] ABSTRACT

The invention provides for a toileting module which can be used in a standard wheelchair and consists of straps and a tensioning mechanism therefor attached to a support structure. The straps run under the wheelchair-bound person and, when tightened, raise the person above the seat cushion permitting its removal and the insertion of a waste receptacle for toileting.

7 Claims, 4 Drawing Sheets

WHEELCHAIR TOILETING MODULE AND METHOD

BACKGROUND OF THE INVENTION

The invention relates to wheelchairs, and, more specifically, to a wheelchair insert that permits toileting from the wheelchair.

People confined to a wheelchair due to paralysis, injury, or age have significant problems associated with using toileting facilities. These problems primarily result from their inability to transfer themselves to a toilet or support their own weight while a bedpan is placed underneath them. Traditionally, an attendant uses a special, manual technique or equipment to lift the person from the chair and lower them onto a toilet with siderails for support.

Special carts/chairs have been developed (U.S. Pat. Nos. 4,856,123 and 4,888,833) to permit a person to be placed over any toilet and not have to leave the cart/-chair for toileting. However, these devices are not wheelchairs and, therefore, a person, if in a wheelchair, must still be transferred to the cart/chair prior to toileting.

To avoid having to lift a wheelchair-bound person, special wheelchairs have been designed to provide the person with the ability to remain in the chair for toileting. (See, e.g., U.S. Pat. Nos. 557,614; 1,691,620; 2,880,783; 3,245,090; 3,271,785; 4,007,959; 4,229,039; 4,296,506; 4,343,482; 4,593,929 and 4,713,848.) However, existing designs present a cleanliness problem. Also, due to the long periods spent in a wheelchair, special cushions, supported by a rigid seat attached to the chair frame, are used to prevent or reduce the incidence of sores and tissue damage. These cushions cannot be used with existing special wheelchair designs since a portion of the cushion and/or rigid seat must be removed for toileting.

A device for raising the person from the wheelchair seat to provide access for seat cushion and clothing removal, and to permit insertion of a specially designed bedpan would solve these problems. Such a device would not require the attendant to lift the person in the wheelchair, would prevent cleanliness problems, and would permit the use of special cushions.

SUMMARY OF THE INVENTION

The problems described above are solved, to a great extent, through the practice of the invention. Illustratively, the invention provides two straps, which are attached to a support structure and run front-to-back of the wheelchair, to lift and support a person during toileting. During normal seating, the straps lie loosely directly between the person and the seat cushion, approximately underneath the legs and buttocks. The straps are constructed of any material that will provide sufficient strength to support a person's weight while being thin enough so as not to interfere with the person's seating comfort.

For toileting, the straps are tightened using a tensioning mechanism, lifting the person off the seat cushion. The seat cushion and the center section of the rigid seat base are then removed from the rear of the wheelchair. A portion of the person's clothing is removed and a specially designed bedpan, which mates closely with the person's skin to prevent leakage and is supported in the opening of the rigid seat, can then be inserted underneath the person. After the pan is removed, normal cleanup procedures are followed, the clothing and seat section and cushion are replaced, and the person is lowered by loosening the straps.

Thus, the invention provides for the toileting of a wheelchair-bound person without the need for a human to lift the person and without the cleanliness problems normally attendant to toileting from the wheelchair. Further, the invention is a single, integrated module which can be placed in current wheelchairs with a minimum of modification and which permits the use of seat cushions specially designed for the wheelchair-bound person. For travel, the invention is easily removed, allowing the wheelchair to be folded normally.

For a more complete appreciation of the invention, attention is invited to the following detailed description of a preferred embodiment of the invention taken with the figures of the drawings. The scope of the invention, however, is limited only through the claims appended hereto.

DETAILED DESCRIPTION OF THE PREFERRED EMBODIMENT

Figure 1A:
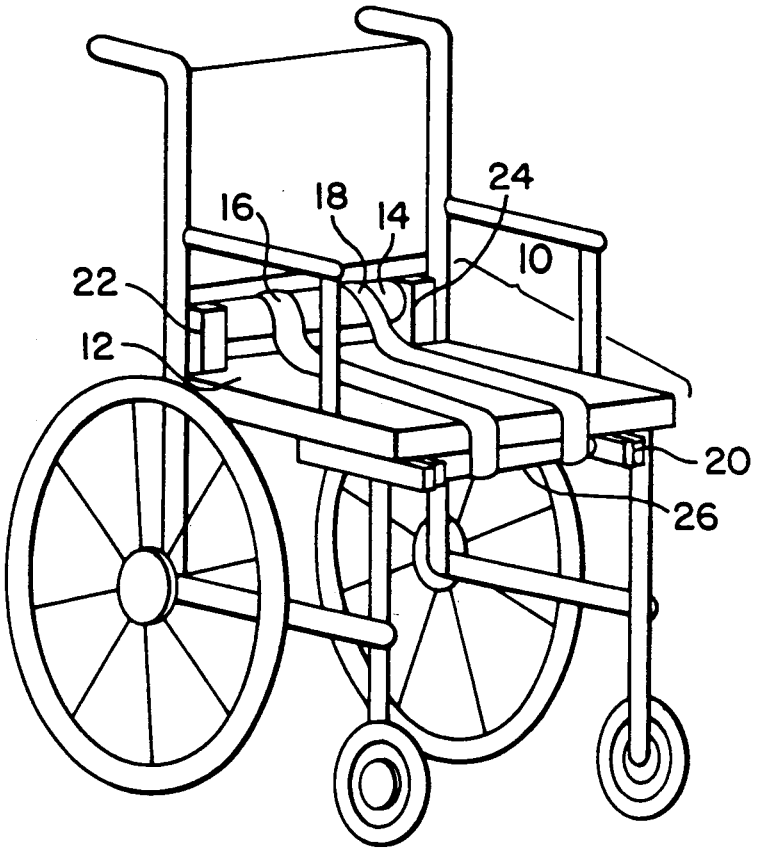
FIG. 1, of FIGS. 1*a*, 1*b*, 1*c* and 1*d*, illustrates the toileting module, inserted in a wheelchair and as a separate unit, in the stored and raised positions.
Figure 1B:
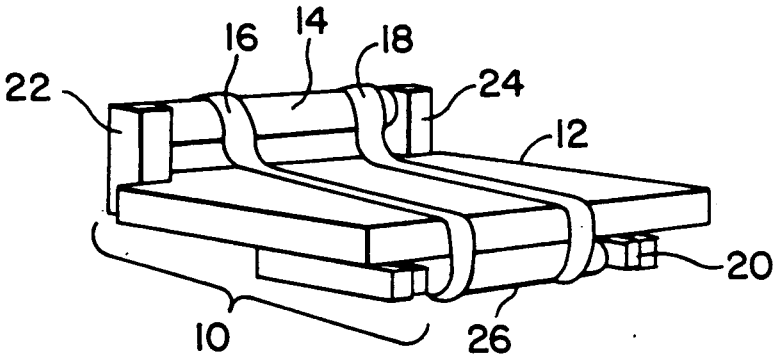
Figure 1C:
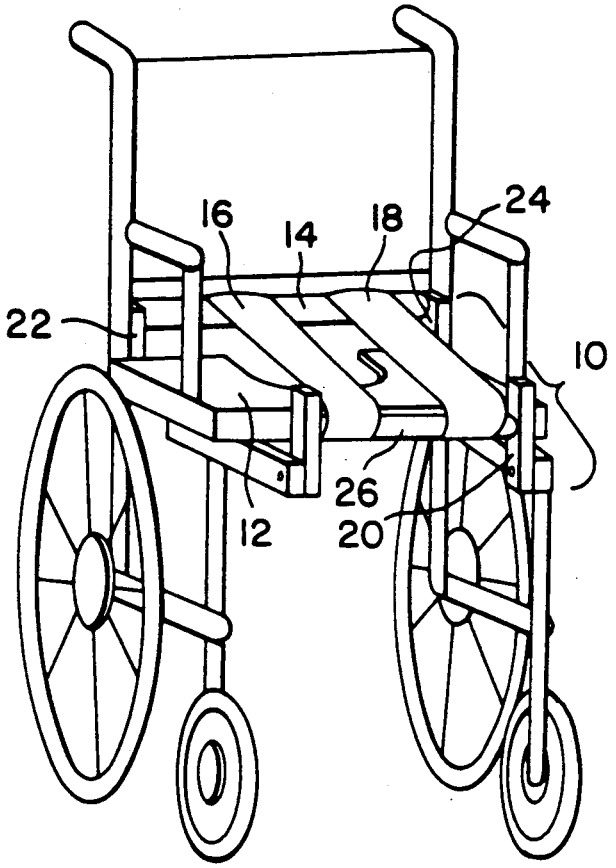
Figure 1D:
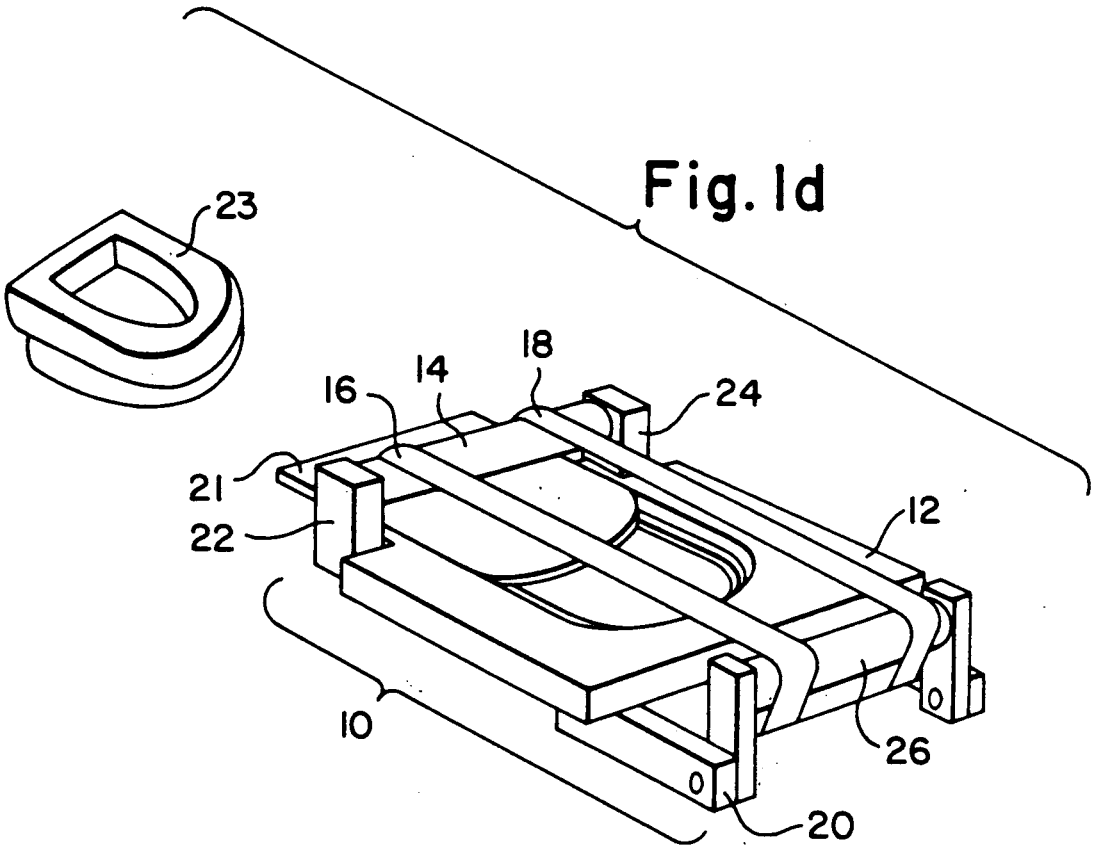

An illustrative embodiment of the invention, inserted in a standard wheelchair and as a separate unit, is shown in FIGS. 1*a*–1*d* of the drawings.

In this embodiment, a support structure 10 is shown which is composed of a seat base 12, a strap anchor bar 14 for one end of the two straps 16, 18, and a leg support 20. The seat base 12 fits on the seat frame (not shown) of the wheelchair underneath the seat cushion (not shown); the seat base 12 has a removable center section 21 (FIG. 1*d*) which can be slid out to the rear of the wheelchair. This permits insertion of a waste receptacle 23 (FIG. 1*d*) and access for cleanup. The waste receptacle is supported in the opening (FIGS. 1*c* and 1*d*) of the seat base 12.

The strap anchor bar 14 is mounted to the rear side of the seat base 12 on support posts 22, 24 which are attached to the seat base 12. The strap anchor bar 14 is at an elevation above the seat base 12 sufficient, when the straps are tightened, to raise the person in the wheelchair high enough to permit removal of the seat cushion and seat base center section and insertion of a waste receptacle 23 (e.g., bedpan).

Figure 2A:
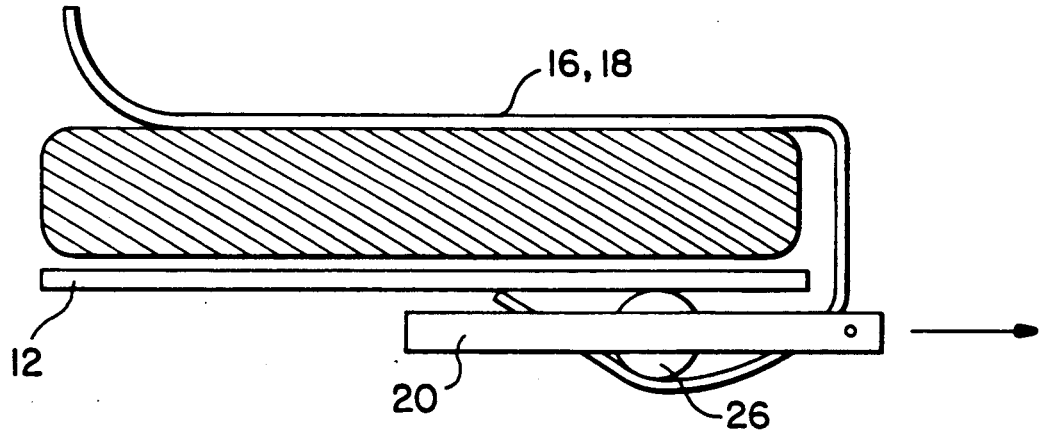
FIG. 2, consisting of FIGS. 2*a* and 2*b*, illustrates a side, schematic view of the leg support in the stored and raised positions.
Figure 2B:
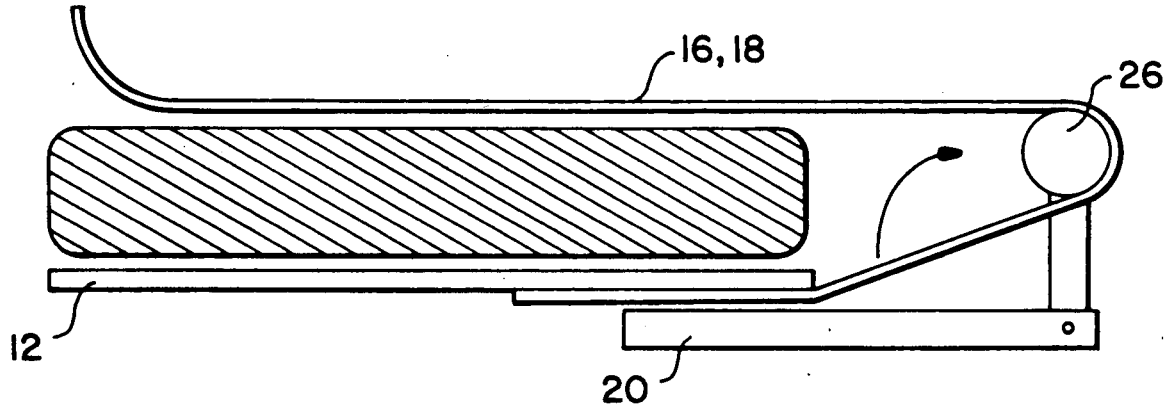

A schematic illustration of the leg support 20 is shown in FIG. 2. The leg support 20 is mounted to the bottom of the seat base 12 so that it can be slid forward and the support bar 26 raised when toileting is desired. The leg support 20 is adjustable for comfort and fit to support the legs of the wheelchair-bound person at approximately the knees. Elevated foot supports (not shown) can also be added to the leg support 20 to provide further comfort and support.

The support structure can be made of any substance with sufficient strength to support the weight of the wheelchair-bound person. However, a glass-epoxy composite with selected graphite-epoxy stiffening elements is preferred. This provides minimum size, parts count, and weight while maintaining full structural integrity.

Attached to the support structure 10 are two straps 16, 18 which will support the person under the thighs and buttocks during toileting. The straps run from a tensioning mechanism 28 (FIG. 3) (mounted on the leg support 20 under the seat base 12) over the support bar 26 and are attached to the strap anchor bar 14 as previously described; they are removable for cleaning or replacement. During normal seating the straps will run between the person and the seat cushion. The straps can be constructed of any washable material that is sufficiently thin to be unnoticed during normal seating but strong enough to support the person during toileting.

Figure 3:
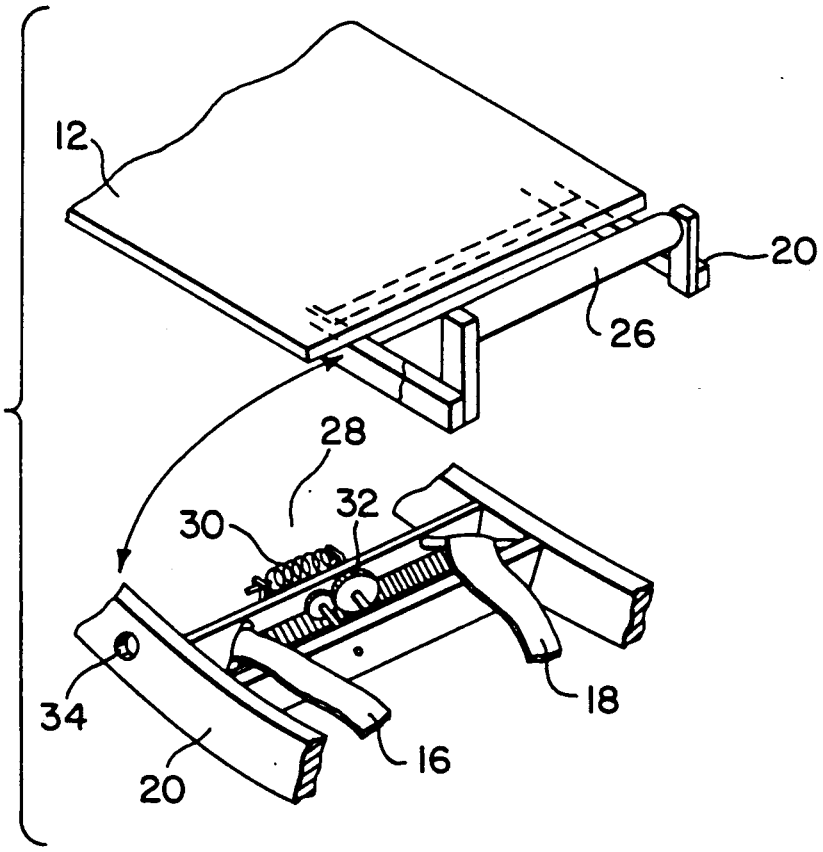
FIG. 3 illustrates a typical embodiment of the tensioning mechanism of the invention.

The tensioning mechanism 28 is shown in FIG. 3. In this embodiment, it is an integral part of the leg support 20 but it could be separate. The mechanism as shown is a simple combination of worm 30 and spur 32 gears well within one of ordinary skill in the art; any similar mechanical arrangement will suffice. The tensioning mechanism 28 is operated by a removable crank (not shown) extending sideways from beneath the seat through an opening 34 in the leg support 20. However, the addition of a motor is a simple matter and within the scope of the invention. The tensioning mechanism 28 is self-locking for safety.

In operation, when toileting is desired, the wheelchair-bound person adjusts the leg support 20 by moving it forward and rotating the support bar 26 upward and locking it in place. Then the person is raised above the seat cushion by the person or an attendant engaging the tensioning mechanism 28, either by means of a crank or via a small motor, and tightening the straps. The seat cushion can then be compressed and removed from the rear of the wheelchair between the support posts followed by the seat base center section. The person's clothing is lowered and a waste receptacle inserted. The waste receptacle is similar to the standard bedpan used in hospitals, but is specially designed to secure to the seat of the toileting module and mate closely to the skin of the person, preventing leakage and soiling of the module and straps. Should soiling occur, parts of the invention, e.g., the straps, can be removed and cleaned (or replaced) with minimal effort. Once toileting and cleanup are complete, the above procedure is reversed to return to normal seating.

There is thus provided in a simple module, which can be inserted in a standard wheelchair with a minimum of modification and be utilized with a specialized seat cushion, a mechanical means for lifting the wheelchair-bound person to permit toileting without the cleanliness problems attendant with other in-chair toileting devices and methods.

What we claim is:

1. A toileting module which can be inserted in a wheelchair having a removable seat cushion comprising:

a seat base placed under said seat cushion;

two straps for supporting a person sitting in said wheelchair above said seat cushion, wherein said straps are positioned under said person's thighs and buttocks and run between said person and said seat cushion;

means for anchoring one end of each of said straps, said anchoring means attached to said seat base;

means for supporting the legs of said person, said legs supporting means attached to said seat base; and means for tensioning said straps to pull said straps tight and thereby raise said person to permit removal of said seat cushion, said tensioning means attached to the unanchored end of each of said straps.

2. The toileting module as recited in claim 1, wherein said legs supporting means is mounted to the bottom of said seat base and slidably movable to a position forward and above the front edge of said seat base to support said legs of said person.

3. The toileting module as recited in claim 1 or 2, wherein said anchoring means comprises:

support posts attached to the rear side of said seat base; and a strap anchor bar mounted on said support posts.

4. The toileting module as recited in claim 1, wherein said seat base further comprises a rearwardly removable center section.

5. The toileting module as recited in claim 3, wherein said legs supporting means comprises a support bar to support said legs of said person.

6. Wheelchair toileting apparatus comprising: a toileting module which can be inserted in a wheelchair, said module comprising:

a seat base;

support posts attached to the rear side of said seat base;

a strap anchor bar mounted on said support posts at an elevation above said seat base sufficient to raise a person sitting in said wheelchair high enough to permit removal of a seat cushion;

means for supporting the legs of said person, said legs supporting means mounted to the bottom of said seat base and slidably movable to a position forward and above the front edge of said seat base to support said legs of said person;

two straps for supporting said person above said seat cushion, one end of each of said straps being attached to said strap anchor bar, wherein said straps are positioned under said person's thighs and buttocks and run between said person and said seat cushion; and means for tensioning said straps to pull said straps tight and thereby raise said person to permit removal of said seat cushion, said tensioning means being mounted on said legs supporting means.

7. The toileting module as recited in claim 6, further comprising means for collecting human waste from said person, said waste collecting means being supported by said seat base, after said seat cushion is removed.

* * * * *